US005320412A

United States Patent [19]

Eakins et al.

[11] Patent Number: 5,320,412

[45] Date of Patent: Jun. 14, 1994

[54] ADJUSTABLE CHAIR

[75] Inventors: Richard Eakins, Toronto; Czeslaw Cimachowski, Don Mills; Brian Bentley, Scarborough; Joe Krommenhoek, Scarborough; Son Ma, Scarborough; David Harding; Nelson Pang, both of Toronto, all of Canada

[73] Assignee: Genus Medical Inc., Concord, Canada

[21] Appl. No.: 788,258

[22] Filed: Nov. 5, 1991

[30] Foreign Application Priority Data

Nov. 14, 1990 [CA] Canada ..... 2029917

[51] Int. Cl.[5] ..... A47C 1/024

[52] U.S. Cl. ..... 297/353; 297/284.1; 297/330; 297/328

[58] Field of Search ..... 297/330, 353, 284.1, 297/284.7, 326–328

[56] References Cited

U.S. PATENT DOCUMENTS

| | | | |
|---|---|---|---|
| 3,059,970 | 10/1962 | Angell et al. | 297/353 |
| 3,147,038 | 9/1964 | Barabas | 297/353 X |
| 3,222,105 | 12/1965 | Cross | 297/353 X |
| 4,054,319 | 10/1977 | Fogg, Jr. et al. | 297/330 X |
| 4,616,874 | 10/1986 | Pietsch et al. | 297/330 X |
| 4,732,423 | 3/1988 | Condon | 297/353 X |

*Primary Examiner*—Peter R. Brown
*Attorney, Agent, or Firm*—Thomas A. O'Rourke

[57] ABSTRACT

The present assembly relates to a wheel chair having a base frame, a seat frame and a back frame, and a control device for rotating the back frame relative to the seat frame. The back frame includes a back support to receive a trunk portion of a user, the back support being displaceable by another control device relative to the back frame. A control unit communicates with the control devices for rotating and for displacing, the control unit being adjustable to vary the displacement of the back support according to the rotation of the back frame to minimize shear forces between the user's trunk and the back support.

20 Claims, 6 Drawing Sheets

ADJUSTABLE CHAIR

The present invention relates to adjustable chairs.

FIELD OF THE INVENTION

A common type of adjustable chair is the motorized wheel chairs, which have helped make the life of a handicapped person more comfortable and more independent. Motorized wheel chairs generally have a seat frame and a back frame, both of which are adjustable relative to a base frame. A back support is usually provided on the back frame to receive the trunk of the user. In some cases, the back support is movable relative to the back frame. The adjustment of these components is made possible by what is referred to in the art as 'tilt', 'recline' and 'zero-shear' mechanisms. Several terms relating to these mechanisms and used commonly amongst those skilled in the art are as follows:

BACKGROUND OF THE INVENTION

'Tilt' refers to a change in angle of the seat frame relative to the wheel chair frame, while the angle of the back frame relative to the seat frame stays constant.

'Recline' refers to a change in the angle of the back frame relative to the seat frame. In this case, the angle of the back frame relative to the seat frame increases or decreases to the desired back frame position while the seat frame angle relative to the wheel chair frame stays constant.

Shearing' refers to the shear or tangential forces that occur as a result of the relative displacement between the user's trunk and the back support. This occurs because the center of rotation of the user's trunk (approximately located at the user's hip joint) does not coincide with the axis of rotation of the back frame. Shearing is a problem because it can cause decubitus ulcers (pressure sores) on the user's body and because it creates problems in maintaining the correct position of the postural supports (e.g. chest pads, headrests) and control devices (e.g. chin control systems) relative to the user.

'Zero-Shear' is an industry used term that refers to a reclining back system that uses a mechanism which significantly reduces (but not necessarily completely) eliminates the effects of shear. Because the back support moves with the user, postural support and control devices are often attached to the back support to maintain correct positioning of these devices relative to the user.

Typically, zero-shear systems utilize a sliding back support that is either attached to the back frame with glide blocks or rollers. Sliding back supports are usually actuated with mechanical linkages, cam or cable systems and which travel at a fixed speed relative to the rotation of the back frame. The conventional devices have been found to be unsatisfactory, since they fail to take into account the specific needs of each user, tend to change from one user to another.

Conventional motorized wheel chairs have also been outfitted with 'anti-tipping' wheels emerging from the chair to support the chair from overturning. However, there are some instances where conventional 'anti-tipping' wheels fail to prevent overturning because they fail to take into account that the centre of gravity of the user may shift as the chair is adjusted.

It is therefore an object of the present invention to obviate or mitigate the above mentioned disadvantages.

SUMMARY OF THE INVENTION

In one aspect, the invention provides a chair comprising a base frame, a seat frame and a back frame, means for rotating said back frame relative to said seat frame, said back frame including a back support to receive a trunk portion of a user, means for displacing said back support relative to said back frame, said means for displacing capable of acting both during rotation of said back frame relative to said seat frame and when said seat frame and back frame are stationary, a control unit communicating with said means for rotating and said means for displacing, said control unit controlling said means for displacing to vary the location of said back support on said back frame to reduce shear forces between said trunk and said back support.

In another aspect, the invention provides a method of adjusting a chair, said chair having a base frame, a seat frame, a back frame and a means for rotating said back frame relative to said seat frame, said back frame including a back support to receive a trunk portion of a user, a means for displacing said back support relative to said back frame, said means for displacing capable of acting both during rotation of said back frame relative to said seat frame and when said seat frame and back frame are stationary, a control unit communicating with said means for rotating and said means for displacing, said method comprising using said control unit to control the location of said back support on said back frame to reduce shear forces between said trunk and said back support.

In a further aspect, the invention comprises a chair comprising:

a base frame;

a seat frame;

a back frame;

a movable back support carried by said back frame, said back support being capable of supporting a trunk portion of a user;

means for rotating said back frame relative to said seat frame;

a means for displacing said back support relative to said back frame, said means for displacing capable of acting both during rotation of said back frame relative to said seat frame and when said seat frame and back frame are stationary; and a controller for controlling said means for displacing to vary the location of the back support relative to the back frame to reduce shear forces between said trunk portion of said user and said back support.

In yet another aspect, the invention comprises a chair comprising:

a base frame;

a seat frame;

a back frame;

a back support slideably located on said back frame for supporting a trunk portion of a user;

a first actuator for rotating said seat frame relative to said base frame;

a second actuator for rotating said back frame relative to said seat frame; and a third actuator for sliding the back support on said back frame to reduce shear forces between said trunk portion of the user and said back support.

BRIEF DESCRIPTION OF THE DRAWING FIGURES

Several embodiments are illustrated by way of example only in the appended drawings, in which.

Figure 1:
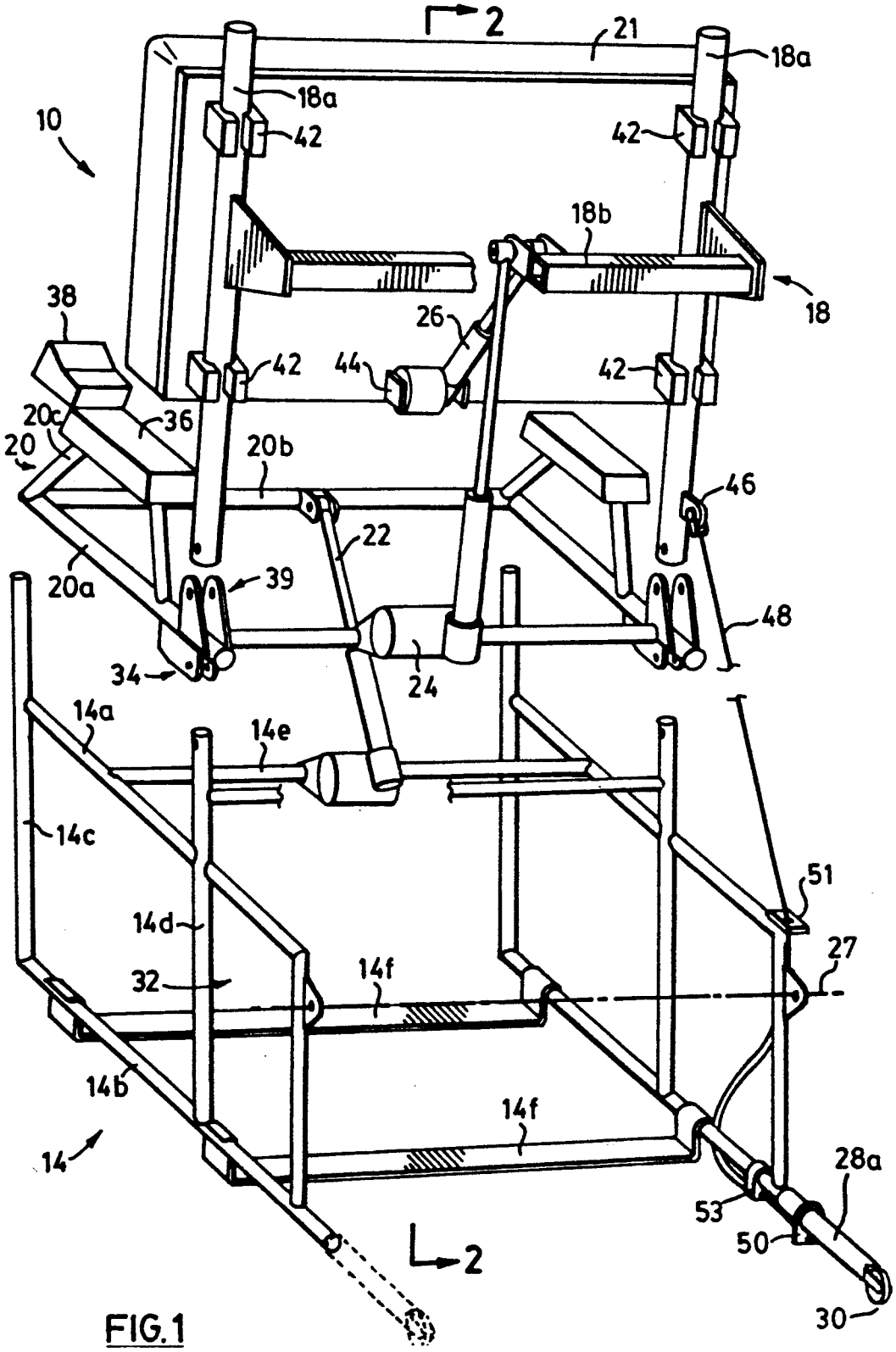
FIG. 1 is an exploded perspective view of a frame for a motorized wheel chair according to one embodiment of the present invention.
Figure 2:
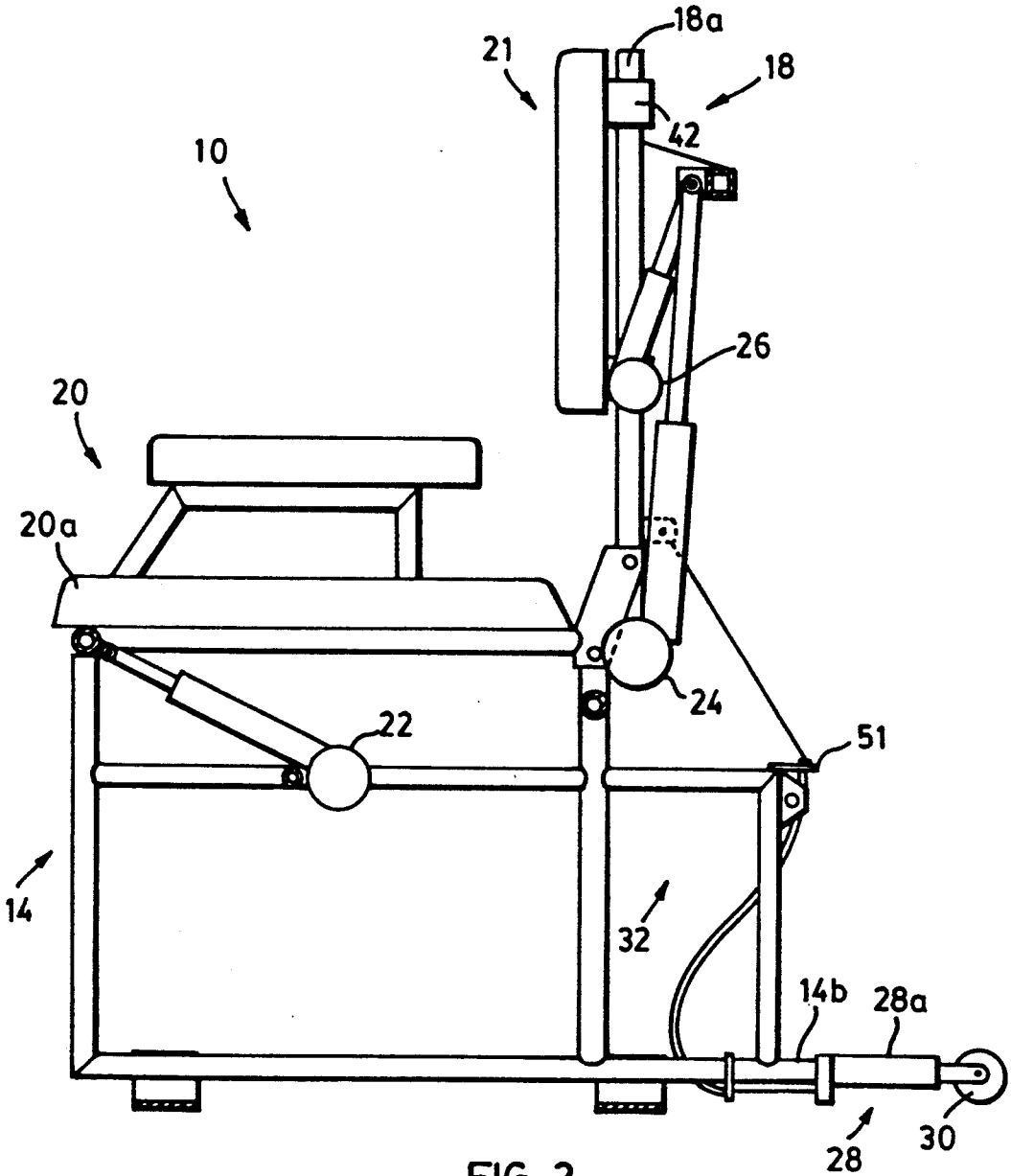
FIG. 2 is a sectional view taken on line 2—2 of FIG. 1.
Figure 5:
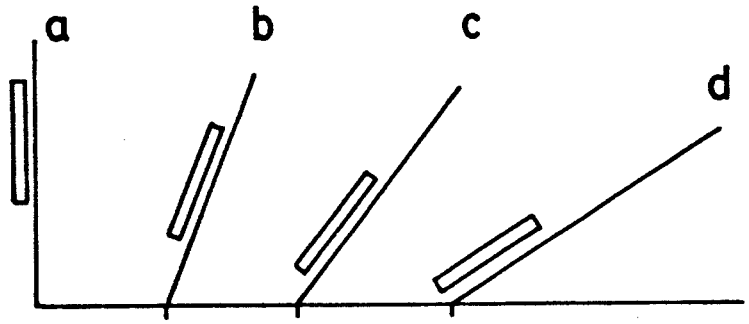
Figure 6:
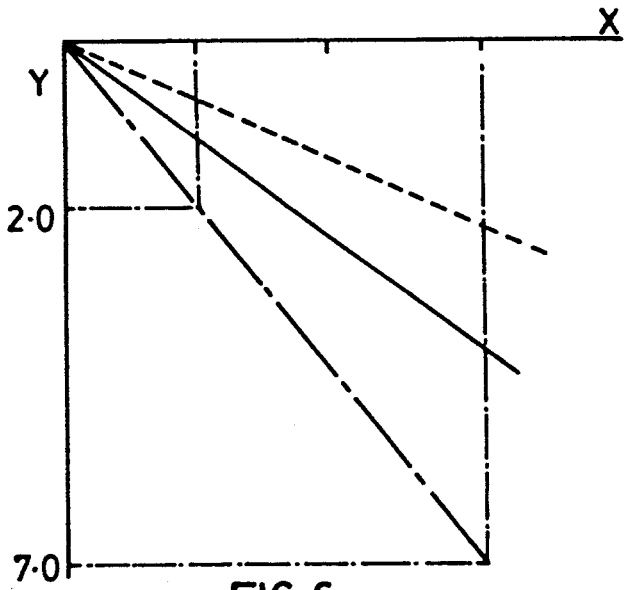

FIGS. 5*a*) to *d*) are schematic views of another portion of the wheel chair illustrated in FIG. 1;

FIG. 6 is a graph corresponding to FIGS. 5*a* to *d;*

Figure 8:
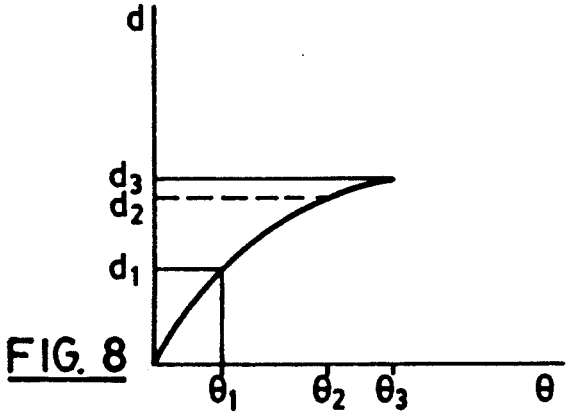
Figure 7A:
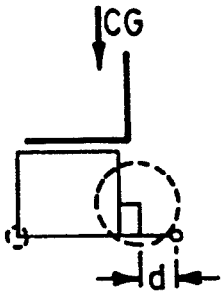
Figure 7B:
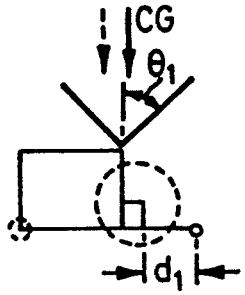
Figure 7C:
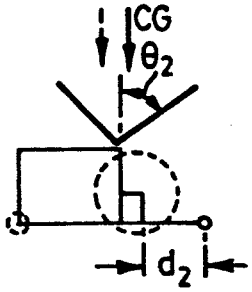
Figure 7D:
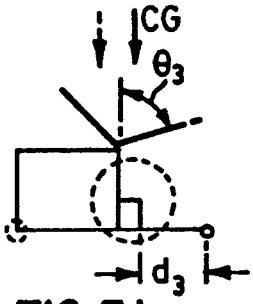
Figure 10:
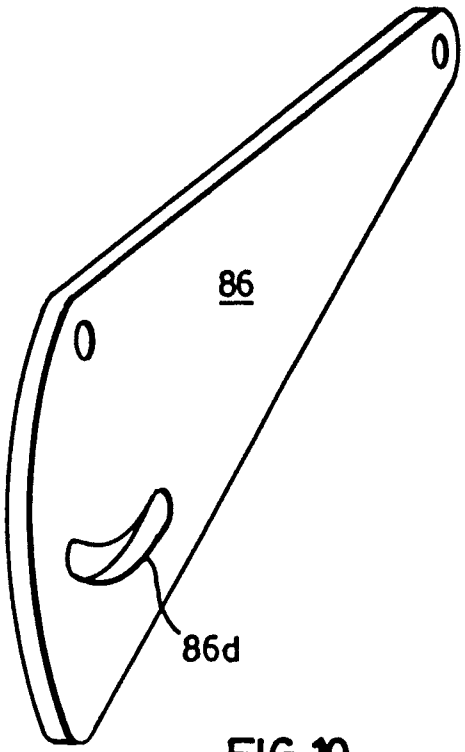
Figure 9:
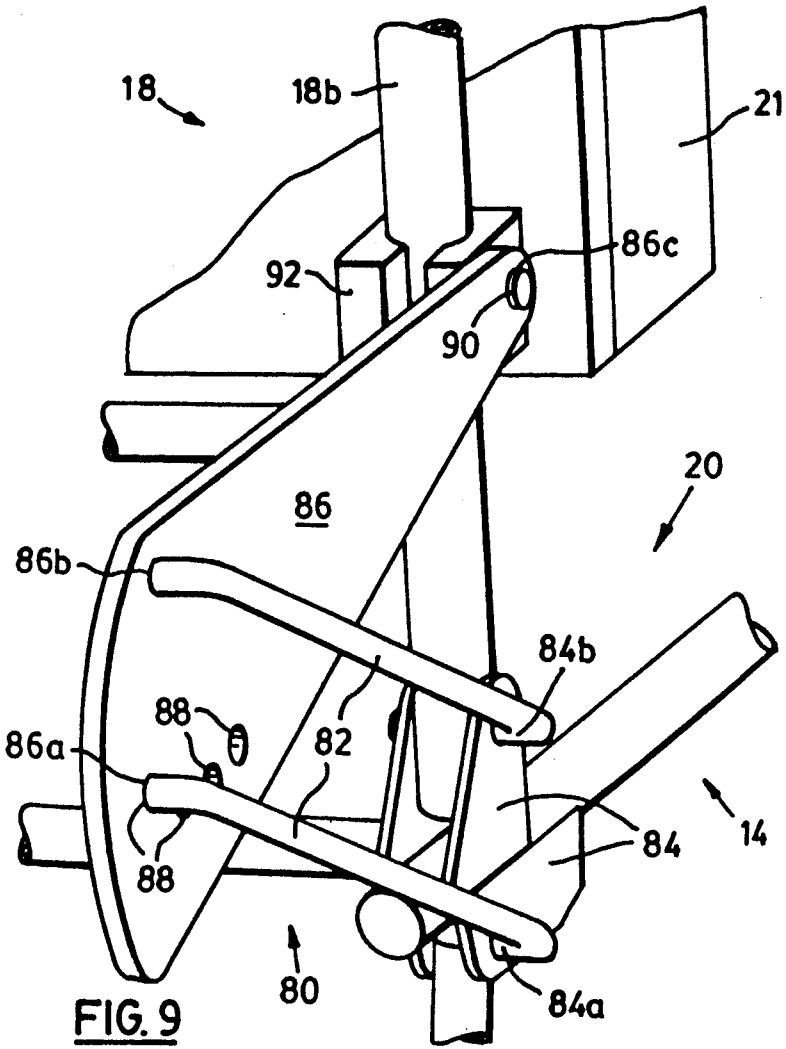

FIGS. 7(*a–d*) are schematic side views of the wheel chair illustrated in FIG. 1;

FIG. 8 is a graph corresponding to FIGS. 7*a*) to *d*);

FIG. 9 is a fragmentary perspective view of a portion of wheel chair according to a second embodiment of the present invention; and FIG. 10 is a perspective view of one component illustrated in FIG. 9.

DESCRIPTION OF PREFERRED EMBODIMENTS

Referring to the figures, there is provided a motorized wheel chair 10, having a base frame 14. A back frame 18 and a seat frame 20 are pivotally coupled to the base frame 14. The seat frame carries seat support 20*a*. A back support 21 is mounted on the back frame 18 for displacement relative thereto and is arranged to receive the trunk portion of a user (not shown). There is provided a means of rotating the seat frame 20 relative to the base frame 14 in the form of a tilt actuator 22, a means of rotating the back frame 18 relative to the seat frame 20 in the form of a recline actuator 24 and a means of displacing the back support 21 relative to the back frame 18, in the form of a zero-shear actuator 26. The linear actuator is known and thus will not be discussed further. The base frame 14 supports a drive train driving a wheel assembly, the rear wheels of the wheel assembly being shown schematically in FIGS. 3 and 7*a*) to *d*). The rear wheels have an axis of rotation identified by line 27.

Figure 3:
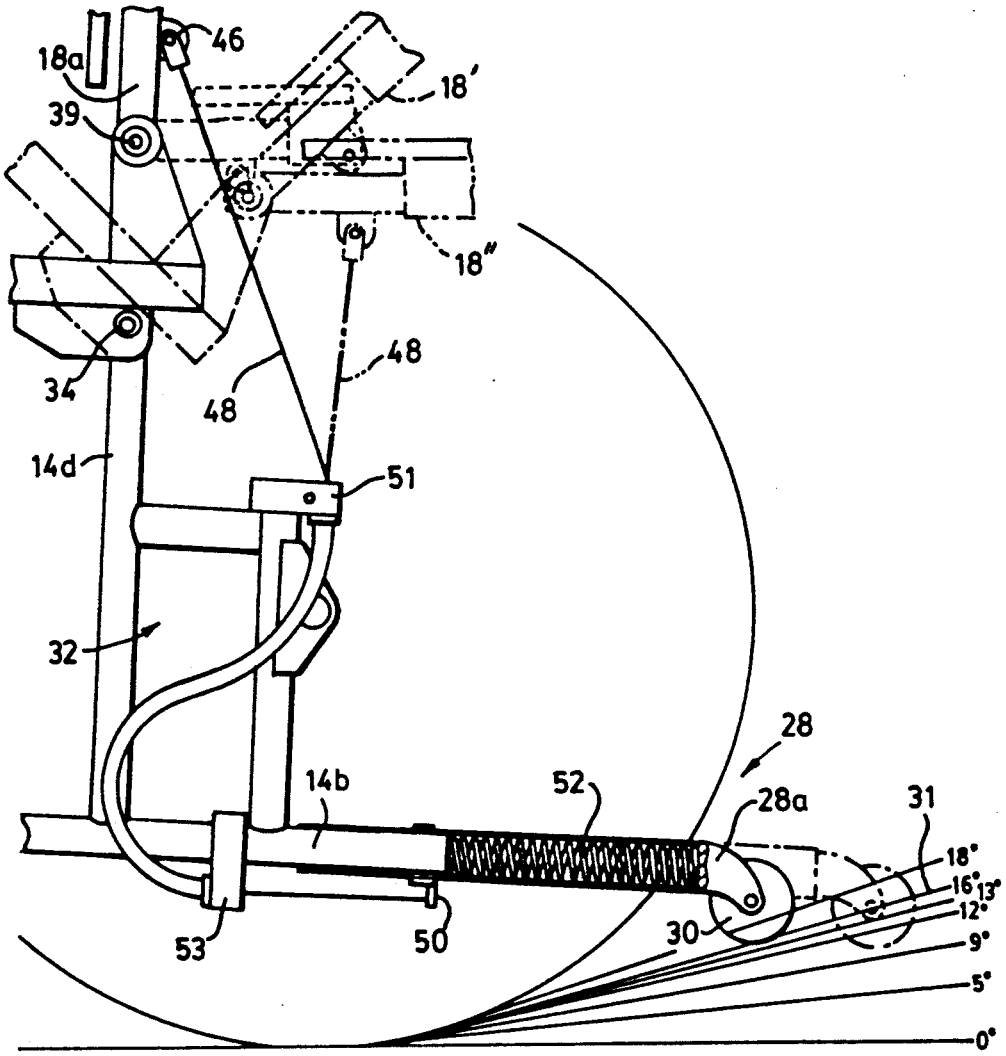
FIG. 3 is fragmentary side view of one portion of the wheel chair illustrated in FIG. 1.

An anti-tipping mechanism 28 is also provided on a lower portion of the base frame 14 and includes a pair of support elements in the form of wheels 30. The wheels are arranged to contact the floor surface upon tipping of the chair. Line 31 in FIG. 3 illustrates the floor surface contacting the wheel 30 when the chair is tipped rearwardly. As will be described, the wheels 30 are movable between a position near said wheel assembly and a position relatively remote therefrom and are responsive to changes in orientation of said back frame 18 relative to the base frame 14. In this manner, the anti-tipping mechanism 28 is responsive to changes in position of a centre of gravity of the user so as to place the wheels 30 at the remote position when the centre of gravity is shifted rearwardly and to place the wheels at the near position when the centre of gravity is shifted forwardly.

The base frame 14 has upper and lower longitudinal members 14*a* and 14*b* on both the left and right hand sides as viewed by the user. Front and rear uprights 14*c*, 14*d* on both sides are joined to the longitudinal members as are upper and lower transverse members, 14*e* and 14*f*, the transverse members 14*f* arranged to carry a battery pack (not shown).

A base frame extension 32 is provided on each side of the chair 10 immediately aft of the corresponding rear upright 14*d* and carries the anti-tipping mechanism 28 as will be discussed.

The seat frame 20 includes a pair of longitudinal members 20*a* and a pair of transverse members 20*b*. A pair of pivot couplings 34 are provided at each of the rear corners of the seat frame 20 to pivot the seat frame 20 to the base frame 14. A pair of arm supports 20*c* extend upwardly from both longitudinal members 20*a* and each carry an arm pad 36. The left hand arm support 20*c* also carries a control unit 38. The front transverse member 20*b* has a mounting flange which carries one end of the tilt actuator 22.

The back frame 18 includes a pair of upright 18*a* joined to an upper transverse member 18*b*. A pivot coupling 39 is provided between the lower end of each upright 18*a* and the rear end of each longitudinal member 20*a* of the seat frame 20 to permit the back frame 18 to pivot relative to the seat frame 20. Four sliding blocks 42 are slidably mounted on the uprights 18*a* and in turn are fixed to a respective corner of a the back support 21.

The upper transverse member 18*b* serves as an anchor for one end of both the recline and zero-shear actuators 24 and 26. The other end of the zero shear actuator is pivotally coupled to a flange 44 emerging from the lower portion of the back support 21, while the opposite end of the recline actuator 24 is mounted on the rear transverse member 20*b* of the seat frame 20.

Each upright 18*a* of the back frame 18 is also provided with an anchor flange 46 to receive one end of a cable 48, the opposite end of which is secured to another anchor flange 50 on the anti-tipping mechanism 28. The cable 48 is further supported by a mount 51 on the corner of the base frame extension 32 and a mount 53 on the lower longitudinal member 14*b*. For the sake of simplicity, only one anti-tipping mechanism 28 is illustrated in detail in the figures.

Figure 4:
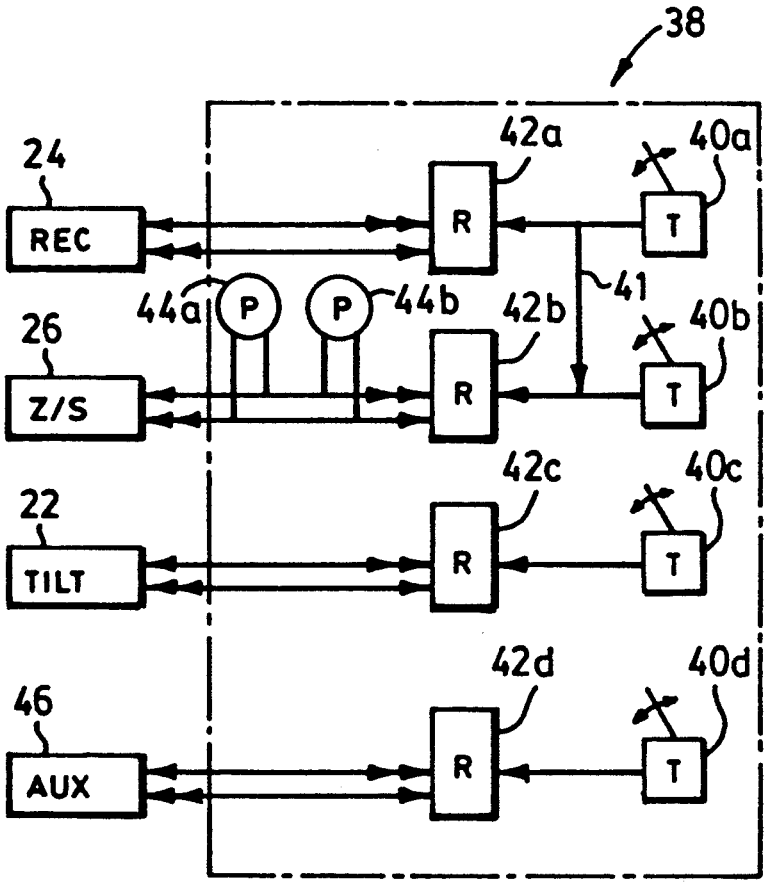
FIG. 4 is a schematic view of another portion of the wheel chair illustrated in FIG. 1.

As will be described, the control unit 38 functions to vary the displacement of the back support 21 according to the rotation of the back frame 18 relative to the seat frame 20 in order to minimize shear forces appearing between the user's trunk and the back support 21. The control unit 38 is schematically illustrated in FIG. 4 and enables the user to adjust the tilt, recline and zero-shear actuators 22, 24 and 26 respectively. The control unit 38 has a number of toggle switches 40*a* to 40*d* which convey a signal to relays 42*a* to 42*d* respectively. Toggle 40*a* is also coupled to relay 42*b* by way of conductor 41 to permit toggle 40*a* to activate relays 42*a* and 42*b* at the same time. Each of the relays 42*a* to 42*d* has an output coupled to an exterior device, such as recline, zero-shear and tilt actuators 22, 24, 26 or to an auxiliary device as is shown at 46, for example a power leg lift actuator.

Located on the output of relay 42*b* are a pair of potentiometers 44*a*, 44*b* which are used to vary the power delivered to the zero shear actuator 26 as will be described.

The toggles and relays are arranged in such a way that the actuators may be powered in two different directions, that is in an upward and downward direction by using the same toggle activated in the same direction. Of course, other switching arrangements may be used to activate the relays, including an interface with a directional controller found on some motorized wheel chairs.

A particular feature of the control unit 38 is the ability to calibrate the chair so that the displacement of the zero-shear actuator may be optimized for the particular needs of each user in a simple and economic manner. This is done by controlling the relative displacement of the zero-shear actuators 26 relative to the recline actuator 24 through adjusting the potentiometers 44*a*, 44*b*, which in turn varies the amount of power being delivered to the zero-shear actuator in the inward direction (that is toward the pivot coupling 39)and outward direction. The two potentiometers are of the type having a diode configuration as is known in the art and allow the speed of the zero-shear actuator in the inward direction to be adjusted independently of the speed in the outward direction. This enables the user to compensate for the effects of gravity by providing an increased amount of power to the zero-shear actuator in the outward direction. Without this compensation, the zero-shear actuator would tend to travel faster in the inward direction.

Thus, as the back frame 18 reclines, the back support 21 slides inwardly toward the pivot couplings 39. Shearing is significantly reduced because the back support 21, in effect, stays in contact with the user's trunk with little or no relative movement. With the toggle 40*b*, the user may adjust the zero-shear actuator independently of the recline actuator.

For example, one user may need to have the back support 21 move only two inches during the full downward rotation of the back frame 18. In this case, the potentiometer is adjusted so that only that amount of power is delivered to the zero-shear actuator to cause it to displace the back support 21 at a speed resulting in two inches of travel in the time it takes to rotate the back between the fully upright position (as shown for example FIG. 5*a*) and fully reclined position (as shown in FIG. 5*d*). This situation is illustrated in FIG. 6 wherein the dashed line represents two inches in a fully reclined position.

Similarly, another user may need to have the back support 21 travel seven inches between the fully upright and fully reclined positions of the back frame 18. Accordingly, the potentiometer is be set to deliver a correspondingly higher amount of power to the zero shear actuator. This example is illustrated by the chain-dot line in FIG. 6.

Once the desirable potentiometer adjustments have been made, the user merely has to operate toggle 40*a*, causing the zero shear actuator to displace the back support 21 while the back frame 18 is being reclined. Another toggle or hit of the toggle switch 40*a* in the same direction causes the polarity of the power delivered to the recline and zero-shear relays to be reversed causing the back frame 18 to be returned to its fully upright position.

While the back frame 18 is reclining relative to the seat frame 20, the cable 48 is displaced causing the anti-tipping mechanism 28 to extend the wheel 30 outward. In this economical manner, the anti-tipping mechanism 28 need not be separately controlled by the control unit 38.

The anti-tipping mechanism 28 includes an outer tube member 28*a* telescopingly engaged with the rear section of a corresponding lower longitudinal member 14*b* and is outwardly spring biased by a compression spring shown at 52. Mounted on the remote end of each outer tube member 28 is one of the wheels 30. As can be seen by FIG. 3, the wheels 30 are spaced from the floor surface a sufficient distance to avoid obstacles while being close enough to the floor surface to provide support should the wheel chair tip rearwardly.

A particular feature of the anti-tipping mechanism 28 is that the wheel 30 is in an operative position through its full displacement. In addition, the anti-tipping device is arranged so that the location of the wheel 30 changes with changes in the position of the back frame 18 (as illustrated, for example, at 18, 18' and 18'') relative to the base frame 14 of the chair. This ensures that the location of the wheel 30 varies with any shift of the user's centre of gravity. This relationship is illustrated in FIGS. 7*a*) to *d*). As the back frame 18 rotates downwardly, the centre of gravity, as represented by the vector 'CG' shifts rearwardly, that is, to the right as viewed in the FIGS. 7*a*) to *d*). In turn, the wheel 30 is displaced rearwardly.

It will be seen that the displacement and location of the wheel 30 is a function of the following variables:

i) the length of the cable 48;

ii) the locations of the flanges 46, 50 and mounts 51, 53; and iii) the locations of the pivot couplings 34 and 39.

Accordingly, the displacement and location of the wheel relative to the back frame may be adjusted if desired by altering these variables.

When the back frame 18 is returned to its full upright position, the wheel 30 is retracted. Thus, the anti-tipping mechanism 28 maintains the user's support through all back frame 18 inclinations, while improving manoeverablity by keeping the wheels 30 out of the way when the user's centre of gravity is not in a position requiring the wheels to be remotely located.

Another advantage of the spring biased anti-tipping mechanisms 28 is that, in most situations, the outer tube member 28*a* is only partially telescoped with the rear section of the lower longitudinal member 14*b*, which means that the wheels 30 will spring inwardly should they make contact with walls, doors and the like, thereby reducing damage. As soon as the wheel 30 moves away from the obstacle, it returns to its appropriate position, which would be sufficient to prevent the chair from tipping over in normal situations.

Should the cable 48 break, the outward spring biased wheel 30 immediately springs to the fully extended position, thereby ensuring that the user's safety is maintained. Of course, the outwardly biasing spring could be replaced by some other biasing member or could perhaps be integrated into the control unit 38 by making use of a linear actuator to displace the wheel.

In alternative embodiment as shown by FIG. 9, the zero-shear linear actuator is replaced by a linkage means for displacing said back support relative to the back frame in the form of a multiple link mechanism 80. The mechanism includes a pair of parallel links 82 pivotally connected at one end to a corresponding pair of locations on said seat frame, namely at the coupling flange 84 joining the seat frame 20 to the back frame 18. The opposite ends of the parallel links 82 are pivotally coupled to spaced locations on a third link 86. One of those locations, namely that identified by 88 is characterized by several pivot holes, each of which arranged to receive a pivot pin, not shown. The third link 86 has a third location 86*c* which is pivotally coupled to the lower block 92 of the back support 21.

The selection of one of three, or more if desired, locations on the third link allows the orientation of the third link to be changed relative to the parallel link. Any change in the orientation of the third link will cause a corresponding change to the travel of the location 86c and thus to the back support 21 as the back frame 18 is rotated between a fully upright position and a fully reclined position.

In use, the back frame 18 is reclined by the reclining linear actuator, which causes the parallel links 82 to rotate downwardly. As this occurs, the third link 86 rotates causing the 'third' pivot to follow both a downward and outward path. It is this path that can be adjusted by the selection of one of the alternative locations 88, since each location will define a different path to be taken by the third link 86 and thus the back support 21.

If desired, the pivot holes 86a may be replaced by a slot 86d, as illustrated in FIG. 10, wherein the corresponding parallel link is pivotted to a given location along the slot. The advantage with this arrangement is that the location of the pivot is adjustable along the length of the slot.

While the above discussion has been restricted to wheel chairs, it will of course be recognized that some of the features disclosed may be appilcabe to other support devices, such as dentist chairs.

It should also be recognized that minor variations to the embodiments disclosed therein will not depart from the spirit of the invention. For example, several alternative arrangments exist for the anti-tipping mechanism shown. The tubes need not telescope relative to one another, provided sufficient support is provided for the wheel to be in an operative position in all positions of the back support 21. The back support 21 may of course be mounted on the uprights in a number of different arrangements, including the use of tracks and the like. While the discussion above has been restricted to the use of wheels 30 in the anti-tipping mechanism, it will of course be understood that other forms of support elements may be used such as downwardly projecting support pegs. In addition, the anti-tipping mechanism may be used to support the chair in other locations, for example, the front or the sides thereof. Other means may be employed to displace the support element relative to a given shift of the centre of gravity, including the use of electronic sensors coupled to anti-tipping mechanism in the form of a linear actuator driven support element or the like.

We claim:

1. A chair comprising a base frame, a seat frame pivotally connected to the base frame, and a back frame pivotally connected to the seat frame, a means disposed between said back frame and said seat frame for rotating said back frame relative to said seat frame, said back frame including a back support to receive a trunk portion of a user, a means disposed between said back support and said back frame for displacing said back support relative to said back frame, said means for displacing capable of acting both during rotation of said back frame relative to said seat frame and when said seat frame and back frame are stationary, and an electronic control unit communicating with said means for rotating and said means for displacing, said control unit controlling said means for displacing to vary the location of said back support on said back frame to reduce shear forces between said trunk and said back support.

2. A chair as defined in claim 1 further comprising a means disposed between said seat frame and said base frame for rotating said seat frame relative to said base frame, said control unit communicating with said means for rotating said seat frame.

3. A chair as defined in claim 2 wherein said control unit is accessible to said user to permit said user to make adjustments to the orientation of said back frame, said back support and said seat frame.

4. A method of adjusting a chair, said chair having a base frame, a seat frame pivotally connected to the base frame, a back frame pivotally connected to the seat frame and a means disposed between the back frame and the seat frame for rotating said back frame relative to said seat frame, said back frame including a back support to receive a trunk portion of a user, a means disposed between the back frame and the seat frame for displacing said back support relative to said back frame, said means for displacing capable of acting both during rotation of said back frame relative to said seat frame and when said seat frame and back frame are stationary, and an electronic control unit communicating with said means for rotating and said means for displacing, said method comprising using said control unit to control the location of said back support on said back frame to reduce shear forces between said trunk and said back support.

5. The method of claim 4 wherein said step of using said control unit further comprises the step of adjusting the location of said back support on said back frame when said back frame is stationary.

6. The method of claim 4 wherein said step of using said control unit further comprises the step of adjusting the location of said back support on said back frame as said back frame is rotated relative to said seat frame.

7. A chair comprising:

a base frame;

a seat frame pivotally connected to the base frame;

a back frame pivotally connected to the seat frame;

a movable back support carried by said back frame, said back support being capable of supporting a trunk portion of a user;

a means disposed between said back frame and said seat frame for rotating said back frame relative to said seat frame;

a means disposed between said back support and said back frame for displacing said back support relative to said back frame, said means for displacing capable of acting both during rotation of said back frame relative to said seat frame and when said seat frame and back frame are stationary; and an electronic controller for controlling said means for displacing to vary the location of the back support relative to the back frame to reduce shear forces between said trunk portion of said user and said back support.

8. The chair of claim 7 wherein said means for displacing said back support comprises an electromechanical means.

9. The chair of claim 8 wherein said electro-mechanical means extends between, and is coupled to, said back support and said back frame.

10. The chair of claim 9 wherein said electromechanical means comprises a linear actuator.

11. The chair of claim 7 wherein said controller controls said means for displacing to adjust the location of said back support on said back frame when said back frame is stationary.

12. The chair of claim 7 wherein said controller controls both said means for displacing and said means for rotating to vary the location of said back support on said back frame as said back frame is rotated relative to said seat frame.

13. The chair of claim 12 wherein said controller further includes a means for calibrating the movement of said back support on said back frame as said back frame rotates relative to said seat frame.

14. The chair of claim 13 wherein said means for calibrating has at least one potentiometer for controlling power input to said means for displacing.

15. The chair of claim 14 wherein said means for calibrating comprises first and second potentiometers, wherein said first potentiometer controls said means for displacing in a first direction, and said second potentiometer controls said means for displacing in a second direction.

16. The chair of claim 11 or 13 wherein said controller comprises a control unit operable by the user, wherein the user can simultaneously operate said means for rotating and said means for displacing to vary the location of said back support relative to said back frame as said back frame is rotated relative to said seat frame and, when said back frame is in a desired stationary position, the use can operate said means for displacing independently of said means for rotating to adjust the position of the back support on said back frame.

17. The chair of claim 16 wherein said control unit is operable using switches accessible to the user, wherein one switch simultaneously operates said means for rotating and said means for displacing, and another switch operates said means for displacing independently of said means for rotating.

18. A chair comprising:

a base frame;

a seat frame pivotally connected to the base frame;

a back frame pivotally connected to the seat frame;

a back support slideably located on said back frame for supporting a trunk portion of a user;

a first actuator disposed between said seat frame and said base frame for rotating said seat frame relative to said base frame;

a second actuator disposed between said back frame and said seat frame for rotating said back frame relative to said seat frame; and a third actuator comprising means disposed between said back support and said back frame for sliding the back support on said back frame as said back frame is rotated to reduce shear forces between said trunk portion of the user and said back support.

19. The chair of claim 18 further comprising an electronic controller for controlling at least said third actuator to slide the back support on said back frame independently of rotation of said back frame.

20. The chair of claim 18 further comprising an electronic controller for controlling said first, second and third actuators to vary the location of said back support relative to said back frame as said back frame is rotated relative to said seat frame, and to adjust the location of said back support on said back frame when said back frame is stationary.

* * * * *